US005266169A

United States Patent [19]

Geary et al.

[11] Patent Number: 5,266,169

[45] Date of Patent: Nov. 30, 1993

[54] APPARATUS FOR SEPARATING AND RECYCLING CLEANING PARTICLES FOR CLEANING FURNACE TUBES

[75] Inventors: Cathy J. Geary, Seabrook; Joseph L. Greene, Jr., Damon; Larry F. Knight, Seabrook; Ronald W. DeLorme, Magnolia, all of Tex.

[73] Assignee: Praxair Technology, Inc., Danbury, Conn.

[21] Appl. No.: 892,576

[22] Filed: Jun. 3, 1992

[51] Int. Cl.[5] ..... C10G 9/16; F28G 1/12; B08B 9/04

[52] U.S. Cl. ..... 196/122; 15/3.51; 15/3.52; 122/395; 165/95; 202/241

[58] Field of Search ..... 15/3.51; 3.52; 165/95; 122/380, 395; 202/241; 196/122; 55/300, 320, 431, 462

[56] References Cited

U.S. PATENT DOCUMENTS

| | | | |
|---|---|---|---|
| 2,670,723 | 3/1954 | Clarkson | 122/395 |
| 3,919,732 | 11/1975 | Honma et al. | 15/3.51 |
| 4,237,962 | 12/1980 | Vandenhoeck | 165/1 |
| 4,297,147 | 10/1981 | Nunciato et al. | 134/7 |
| 4,350,202 | 9/1982 | Schultz et al. | 165/95 |
| 4,420,038 | 12/1983 | Okouchi et al. | 165/95 |
| 4,509,589 | 4/1985 | Carlson et al. | 165/95 |
| 4,544,027 | 10/1985 | Goldberg et al. | 165/95 |
| 4,865,121 | 9/1989 | Ben-Dosa | 165/95 |

FOREIGN PATENT DOCUMENTS

| | | | |
|---|---|---|---|
| 1124624 | 3/1962 | Fed. Rep. of Germany | 122/395 |
| 82299 | 6/1980 | Japan | 122/395 |

*Primary Examiner*—Joye L. Woodard
*Attorney, Agent, or Firm*—Alvin H. Fritschler

[57] ABSTRACT

A center transfer unit positioned between a solids collection chamber and a cleaning particle vessel contains vibrating inclined screens to separate chunks of waste solids from cleaning particles recycled to the cleaning particle vessel.

13 Claims, 1 Drawing Sheet

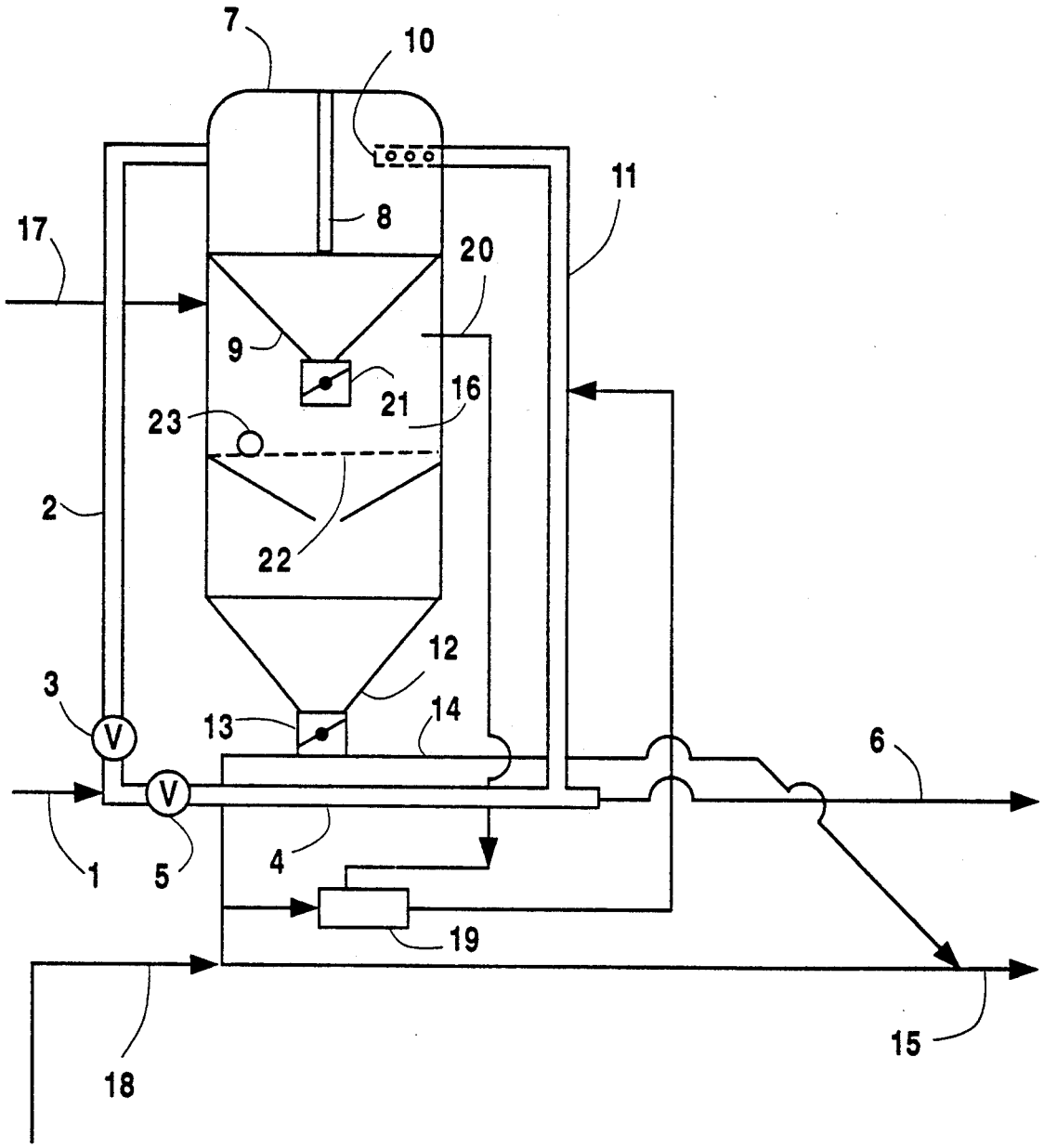
7
10
11
8
17
20
9
21
16
23
2
22
12
3
13
14
6
V
V
1
5
4
19
18
15

APPARATUS FOR SEPARATING AND RECYCLING CLEANING PARTICLES FOR CLEANING FURNACE TUBES

BACKGROUND OF THE INVENTION

1. Field of the Invention

This invention relates to the cleaning of furnace tubes. More particularly, it relates to reducing the amount of solids waste generated in the in-situ cleaning of furnace tubes.

2. Description of the Prior Art

In the hydrocarbon furnaces located in various refineries and petrochemical plants, it is necessary to remove coke deposits from the inner walls of furnace tubes. Such deposits form and grow during continuous operations leading to excessive pressure drop across the tubes, reduced throughput therein and reduced thermal efficiency of the furnace. While mechanical cleaning, hydroblasting and steam-air decoking are techniques known in the art for such internal furnace tube cleaning purposes, the in-situ cleaning of furnace tubes and other such conduits by the passage therethrough of steel shot or other cleaning particles entrained in a propelling gas stream is a highly advantageous and desirable approach. In-situ cleaning operations can be carried out, in batch-type cleaning runs, without disassembling the furnace and, particularly by the use of steel shot, without appreciable erosion of the return bend portions of the furnace tubes, and without the furnace cool downs required for other cleaning approaches.

Because of these and other advantages, the in-situ cleaning and decoking of furnace tubes and other pipelines is carried out as part of the Sandjet ® in-situ cleaning process service activity of Union Carbide Industrial Services Company. In this in-situ process, cleaning particles are entrained in a propelling gas stream, preferably a nitrogen stream, and passed through the line, e.g. a bank of furnace tubes commonly oriented in a serpentine configuration. For furnace tube operations, the cleaning particles are desirably impact resistant, non-angular non-abrasive particles, such as steel shot, that effectively remove coke deposits from the internal walls of the furnace tubes by impact rather than by grinding or abrasion-type cleaning action. In this cleaning approach, further described in the Nunciato et al. patent, U.S. Pat. No. 4,297,147, the steel shot or like cleaning particles being passed through the furnace tubes have turbulent and swirl velocity components induced therein, causing them to strike the coke deposits with sufficient energy to dislodge chunks of coke that are swept from the furnace tubes by the propelling gas stream, along with the cleaning particles and loose coke debris. Such in-situ decoking enables the internal walls of the furnace tubes to be effectively cleaned, as in the more difficult to clean straight sections, without undue erosion of the return bend portions of the furnace tubes.

It will be appreciated that commercial in-situ furnace tube cleaning applications produce a considerable amount of waste material, including the coke removed from the furnace tubes and steel shot or other cleaning particles used in the cleaning process. The amount of waste varies with the size of the furnace, but is typically in the range of 1-3 tons per furnace cleaning. As landfill regulations become more stringent, solids waste disposal is an increasingly more difficult problem. There is a genuine need in the art, therefore, to reduce the amount of solids waste requiring disposal, and, in particular, it is highly desirable to reduce the amount of solids waste disposal associated with in-situ furnace tube cleaning operations.

It is an object of the invention, therefore, to provide an improved system for the in-situ cleaning of lines with minimized generation of solids waste requiring disposal.

It is another object of the invention to provide a system for achieving a significant reduction in the amount of solids waste to be disposed of as a result of the in-situ cleaning of pipelines.

With these and other objects in mind, the invention is hereinafter described in detail, the novel features thereof being particularly pointed out in the appended claims.

SUMMARY OF THE INVENTION

The discharge stream removed from furnace tubes or other such lines during in-situ cleaning thereof is passed to a solids recycle collection chamber conveniently positioned on top of the cleaning particles supply vessel for the system. Solids, including the cleaning particles and chunks of coke or other solids removed from the line are knocked out of the propelling gas stream and collected in the collection chamber. Upon completion of a cleaning pass, the cleaning particles are effectively transferred through a center transfer unit into the cleaning particles supply vessel for use in the next cleaning run.

BRIEF DESCRIPTION OF THE DRAWING

The invention is hereinafter described with reference to the accompanying single FIG. drawing that consists of a schematic view of the apparatus of the invention used to recycle steel shot or other cleaning particles for re-use in the in-situ cleaning of furnace tubes and other such lines.

DETAILED DESCRIPTION OF THE INVENTION

The objects of the invention are accomplished by use of a recycle system that enables steel shot or other cleaning particles, and heavy particles removed from the line to be separated from the propelling gas stream discharged from a line upon in-situ cleaning thereof, with the cleaning particles being separated for convenient re-use in further cleaning passes of the batch-type in-situ cleaning operation. As a result, the generation of waste solids to be removed for disposal can be significantly reduced, e.g. up to 80% or more in some instances. Thus, the invention enables the desirable in-situ cleaning process to be carried out with a significant reduction in solids waste for disposal and with a desirable reduction in overall operating costs.

The waste recycle system of the invention for use with a Sandjet in-situ cleaning unit comprises a unit for collecting the material discharged from a furnace during each process cleaning run and for passing the cleaning particles back to the Sandjet cleaning unit for the next cleaning run in the batchwise Sandjet in-situ cleaning process. The cleaning particles can thus be used throughout the in-situ cleaning process. With reference to the drawing, the waste stream discharged from the furnace tubes being cleaned by the in-situ Sandjet process is passed to the waste recycle system at the inlet thereof designated by the numeral 1. Line 2 containing suitable valve means 3, e.g. butterfly valve, is provided to pass the waste stream to the recycle unit. Line 4 containing suitable valve means 5, e.g. butterfly valve, is provided to enable the waste stream to bypass the recycle unit and pass to disposal 6. When the waste stream is passed through line 2 for collection and recycle, it passes into collection chamber 7, which is conveniently mounted on top of a Sandjet cleaning particle vessel referred to below. In said collection chamber 7, the waste stream is caused to impinge on baffle plate 8 positioned in the line of flow thereof. As a result, solids are knocked out of the waste stream and settle in the bottom cone section 9 of collection chamber 7. The gas stream, comprising the propelling gas used in the Sandjet process and light particles and debris entrained therein, passes through gas exit strainer 10 adapted to knock out the lighter solid material therefrom. The residual gas stream then leaves collection chamber 7 through outlet line 11 that passes to disposal 6.

Once a particular Sandjet in-situ cleaning run is completed and the recycled material is held in collection chamber 7, the recycled material is transferred to the Sandjet in-situ cleaning particles vessel 12 for use in the next in-situ cleaning run. Cleaning particles vessel 12 delivers cleaning particles at a specified material feed rate through valve 13 for introduction into a nitrogen or other propelling gas side stream flowing in line 14 for passage to the furnace tubes, designated generally by the numeral 15, to be cleaned by the in-situ Sandjet cleaning process.

For purposes of transferring the solid waste material held in collection chamber 7 to Sandjet cleaning particles vessel 12, a transfer unit is incorporated into the overall waste recycle system of the invention. The transfer unit includes center vessel 16 positioned between collection chamber 7 and cleaning particles vessel 12. Center vessel 16 is operated under vacuum, which serves to keep dust particles within the waste recycle system. This provides desirable protection to operating personnel in the vicinity of the waste recycle system. It also provides a suitable means for loading the system with cleaning particles from an outside source through line 17.

The vacuum may be created in center vessel 16 by conveniently diverting a portion of the propelling gas stream passing in line 18 to furnace tubes 15 for passage through eductor 19. Line 20 provides fluid communication between the neck portion of eductor 19 and center vessel 16 so as to draw a vacuum therein. The discharge from eductor 19 is connected to outlet line 11 for passage to disposal 6. Material transfer from collection chamber 7 to Sandjet cleaning particles vessel 12, by means of center vessel 16, is initiated by opening butterfly valve 21 located at the bottom of collection chamber 7. The waste matter thus passes from collection chamber 7 into center vessel 16, in which it passes through inclined screen 22 having vibrator means 23 attached thereto. Screen 22 is installed with a slope so as to allow chunks of coke particles removed from a furnace tube wall being cleaned to migrate to the lower positioned end of the screen, thereby preventing blockage or plugging of the screen by such coke particles and potential material held-up on the screen. As the recycled cleaning particles pass through the screen, they fall through the lower, preferably cone-shaped portion thereof into Sandjet cleaning particles vessel 12 for ready use in the next succeeding Sandjet process cleaning run. The coke that migrates to the lower end of the inclined screen can generally be allowed to accumulate for removal during equipment cleaning at the end of a Sandjet operation.

The waste recycle system of the invention enables the highly desirable recycle of cleaning particles to be accomplished in a manner that can be carried out successfully, without bridging of waste material and without plugging of the screen, enabling the amount of cleaning particles recycled to be enhanced, and the amount of waste material discharged from the system to be minimized, thereby enhancing the overall technical and economic feasibility of employing the highly advantageous in-situ Sandjet cleaning process in practical commercial operations.

Those skilled in the art will appreciate that various changes can be made in the details of the invention as herein described without departing from the scope of the invention as set forth in the appended claims. Thus, while the invention has been described particularly with respect to the decoking of furnace tubes, the waste recycle system of the invention can be used for heat exchangers and other pipeline cleaning applications in which the advantageous in-situ Sandjet process is employed. While steel shot is a desirable cleaning particle for the decoking of various furnace tubes, it will be appreciated that any other suitable cleaning particles, e.g. flint, grit, plastic or metal particles or the like can be used in particular applications and recycled for further use by means of the waste recycle system of the invention. Likewise, the various valves and process lines, and supporting control equipment, can be selected from known, commercially available sources for ready use within the scope of the invention.

As noted above, screen 22 employed in center vessel 16 is inclined to enable coke particles to migrate to the lower end thereof, thus preventing plugging of the screen. For this purpose, the screen is generally positioned at an angle of from about 5° to about 30°, preferably screen will desirably have openings of at least twice the size of the largest cleaning particles employed Thus, a ¼" screen opening would be compatible with the convenient use of shot particles ranging from very small up to ⅛' diameter. In general, the screen will be of a size small enough to prevent particles of coke from passing through, while large enough so that steel shot or other particles can pass through to Sandjet cleaning particles vessel 12. In the practice of the invention, only a minimal amount of coke is found to recycle with the cleaning particles. In certain embodiments, the Sandjet cleaning process may be operated for a few initial runs while by-passing the waste recycle system for preliminary removal of the chunks of coke first dislodged from the walls of the furnace tubes. In subsequent runs employing the waste recycle system, coke is separated from the recycle cleaning particles by said inclined screen, and the separated cleaning particles are recycled for further use as herein provided.

The vacuum level employed in center vessel 16 is generally down to about 5 psia with said vacuum typically being in the range of from about 5 to about 10 psia. Vibrator means 23 can be any suitable, commercially available means that provides sufficient vibration to the screen to discourage bridging of the shot or other cleaning particles and to facilitate the migration of coke particles to the lower end of the screen for removal therefrom upon equipment cleaning at the end of a Sandjet cleaning operation. In typical operations, a Sandjet run will last for about 3 minutes, and the material transfer operation using the waste recycle system of the invention will commonly require about 45 seconds. The number of Sandjet process runs will depend on a variety of factors, including the nature of the furnace or other lines to be cleaned, the extent of the deposits on the lines, the particular cleaning particles employed and the like.

By significantly reducing the amount of solids waste requiring disposal, the invention will be seen to contribute in a significant manner to the overall feasibility of the in-situ cleaning of furnace tubes and other lines. The environmental advantages obtained by the practice of the invention are directed to a major and ever growing concern with respect to necessary industrial cleaning operations and their relationship to limited available landfill sites and the regulations pertaining thereto.

We claim:

1. A separation and recycle system for reducing the amount of solids waste requiring disposal generated in the course of the in-situ cleaning of lines by the propelling therethrough of cleaning particles entrained in a propelling gas stream comprising:

(a) a collection chamber containing baffle means positioned to impact a propelling gas stream containing entrained cleaning particles and solids waste particles removed from the inner walls of a line being cleaned upon the flow of said stream into the collection chamber, so as to knock-out solids from said stream, the bottom portion of the collection chamber being cone shaped to facilitate collection of the solids knocked-out of said propelling gas stream;

(b) inlet means for the passage of the propelling gas stream and entrained particles to the collection chamber, (c) outlet means for the removal of the propelling gas stream from the collection chamber for disposal;

(d) a cleaning particles vessel having conduit means for the introduction of cleaning particles into the propelling gas stream for passage to the line to be cleaned;

(e) a center transfer unit positioned between and providing a flow connection for solids between said collection chamber and said cleaning particles vessel, said center transfer unit containing inclined screen means for retaining and causing chunks of solids waste particles to migrate to the lower end thereof, while enabling the cleaning particles to pass through to said cleaning particles vessel;

(f) means for generating a vacuum in said center transfer unit to retain dust particles within the unit; and (g) vibrator means for imparting vibration to said inclined screen means to preclude bridging of the cleaning particles and to facilitate the migration of chunks of solids waste particles to the lower end of said inclined screen means, whereby the cleaning particles used in an in-situ cleaning operation can be recycled and used in further runs of the batch-type in-situ cleaning operation, thereby significantly reducing the amount of solids waste requiring disposal over the course of said in-situ cleaning operation.

2. The system of claim 1 in which said inclined screen means is inclined at an angle of from about 5° to about 30° to the horizontal.

3. The system of claim 2 in which said angle is from about 5° to about 20 .

4. The system of claim 1 in which said means for generating a vacuum is capable of generating a vacuum in the range of from about 5 to about 10 psia.

5. The system of claim 1 in which said inclined screen means has openings of about twice the largest size of said cleaning particles to facilitate the passage of said cleaning particles therethrough.

6. The system of claim 1 including by-pass conduit means in said inlet means upstream of the collection chamber for diverting the propelling gas stream containing entrained cleaning particles and solid waste particles to disposal rather than to the collection chamber.

7. The system of claim 6 in which said inclined screen means is inclined at an angle of from about 5° to about 30° to the horizontal, said inclined screen means having openings of about twice the largest size of said cleaning particles.

8. The system of claim 7 on which said angle is from about 5° to about 20°.

9. The system of claim 7 in which said cleaning particles comprise steel shot.

10. The system of claim 7 in which said cleaning particles comprise steel shot.

11. The system of claim 1 including gas strainer means positioned in the collection chamber so as to knockout lighter solid material from the propelling gas stream prior to the passage of the propelling gas stream from the collection chamber.

12. The system of claim 1 in which said collection chamber is mounted above said cleaning particles vessel and said center transfer unit.

13. The system of claim 1 and including valve means positioned to control the passage of solids from the collection chamber into said center transfer unit.

* * * * *